United States Patent [19]

Hinson

[11] Patent Number: 5,027,639

[45] Date of Patent: Jul. 2, 1991

[54] VEHICLE COLLISION REPAIR SUPPORT RACK

[76] Inventor: Virgil H. Hinson, 206 Fairway Oaks Dr., Brunswick, Ga. 31523

[21] Appl. No.: 465,311

[22] Filed: Jan. 16, 1990

[51] Int. Cl.[5] ..... B21D 1/12

[52] U.S. Cl. ..... 72/457; 72/705

[58] Field of Search ..... 72/457, 705

[56] References Cited

U.S. PATENT DOCUMENTS

| | | | |
|---|---|---|---|
| 4,313,335 | 2/1982 | Eck | 72/457 |
| 4,398,410 | 8/1983 | McWhorter et al. | 72/705 |
| 4,574,614 | 3/1986 | Field | 72/705 |
| 4,794,782 | 1/1989 | Field et al. | 72/457 |
| 4,862,727 | 9/1989 | Bergeron | 72/705 |

*Primary Examiner*—Lowell A. Larson

*Attorney, Agent, or Firm*—Fleit, Jacobson, Cohn, Price, Holman & Stern

[57] ABSTRACT

An ovate vehicle support rack is provided and equipped with a plurality of carriages guidingly supported from the rack for movement along the outer margin thereof and with the carriages projecting outwardly of the rack outer margin. Each carriage supports an upstanding pull tower therefrom for angularly displacement relative to the associated carriage about an upstanding axis and each pull tower upper end includes pull structure for exerting a pull in a direction extending away from the rack and toward the pull tower with the direction of pull being angularly displaceable with the tower relative to the carriage. A lower portion of each pull tower includes a lift arm extending therefrom to a position disposed over the adjacent marginal portion of the rack and the lift arm is pivoted from the pull tower for angular displacement about a horizontal axis extending transversely of the lift arm with the free end of the lift arm being provided with structure for engagement beneath and lifting a vehicle supported from the rack. In addition, vehicle stands are supported from the rack for independent, adjustable transverse and longitudinal shifting relative thereto and are downwardly foldable toward the rack when not in use.

13 Claims, 4 Drawing Sheets

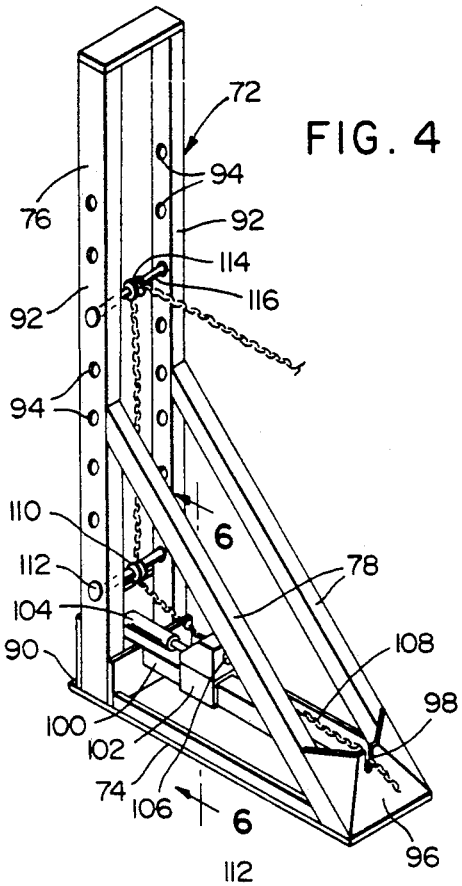
FIG. 4
FIG. 3
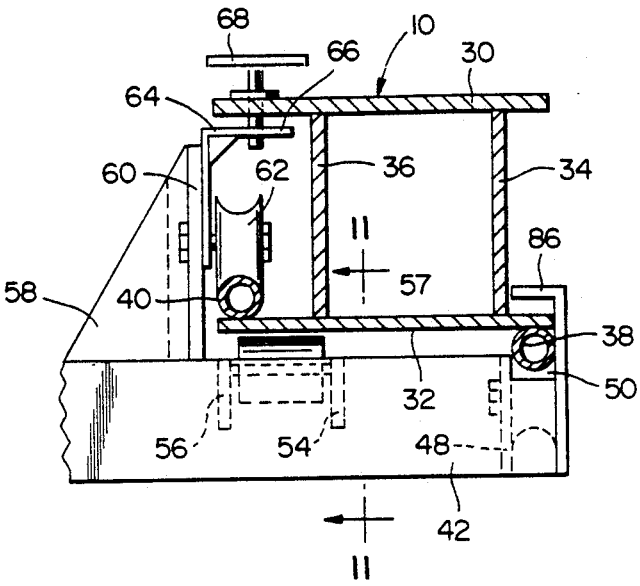
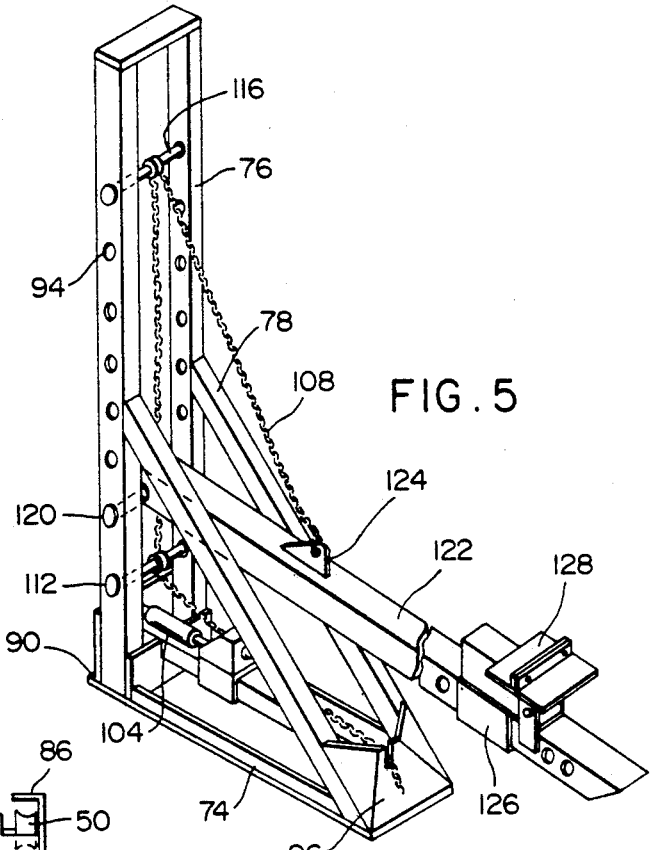
FIG. 5
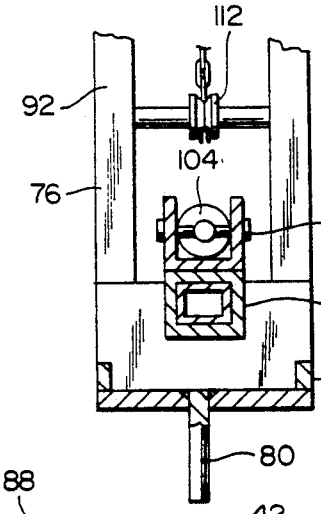
FIG. 6
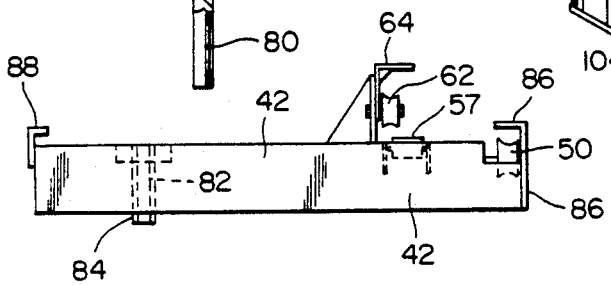
FIG. 7

VEHICLE COLLISION REPAIR SUPPORT RACK

BACKGROUND OF THE INVENTION

1. Field of the Invention

This invention relates to a rack up on to which a vehicle may be moved and from which the vehicle may be stationarily supported for frame, sub-frame and body panel straightening and aligning purposes. The rack defines an outer periphery within the boundaries of which an associated vehicle upon which straightening and aligning work is to be performed may be supported and the outer periphery of the frame includes work platforms supported therefrom for guided movement thereabout and from which pivotal pull towers are supported, which pull towers are basically constructed in the manner disclosed in U.S. Pat. No. 4,712,417, but each are modified to include a vehicle lifting arm. Further, the rack is vertically adjustable while maintaining a horizontal attitude and lock structure is provided for maintaining the rack in selected vertically adjusted positions. Also, the rack is provided with foldably retractable vehicle stands.

2. Description of the Related Art

Various different forms of support racks including some of the general structural and operational features of the instant invention are disclosed in U.S. Pat. Nos. 4,313,335, 4,370,882, 4,398,410, 4,643,015, 4,700,559 and 4,794,783. In addition, pull towers are not only disclosed in the above mentioned U.S. Pat. No. 4,712,417 but also in U.S. Pat. Nos. 4,475,716 and 4,658,627. However, these previously know devices do not include vehicle lift arm equipped pull towers, foldably retractable vehicle stands or racks which may be vertically adjusted and a locked in selected vertically adjusted positions.

SUMMARY OF THE INVENTION

The vehicle repair support rack of the instant invention has been designed to facilitate the application of frame, sub-frame and/or body panel pulls on a vehicle being repaired. The support rack incorporates features which facilitate the application of such repair pulls throughout the entire repair process, including the loading of a vehicle on the repair rack, elevation of the vehicle relative to the rack, stationery anchoring of the vehicle in an elevated position relative to the rack and the placement of one or more pull towers about the vehicle on the repair rack as well as adjustment of the pull tower or towers relative to the vehicle in order to exert angle pulls thereon, if desired. Further, the support rack includes foldably retractable vehicle stands, vehicle lift arm equipped pull towers and pull tower supporting carriages which must be positively locked in adjusted positions rather than reliance upon friction contact between the support rack and carriages during a pull.

The main object of this is to provide a vehicle repair rack upon which a vehicle to be repaired may be loaded, elevated relative to the rack, stationarily anchored in elevated position relative to the rack and have various angle pulls exerted thereon through the utilization of pull towers.

Another very important object of this invention is to provide a repair rack with which body component alignment gages may be readily used.

Still another object of this invention is to provide a vehicle support rack provided with pull towers movable thereabout and wherein the pull towers each include structure for exerting a generally horizontal pull and may have a vehicle lift arm added thereto whereby each pull tower also may be used to elevate a vehicle relative to the repair rack.

A further object of this invention is to provide a vehicle repair rack of the type including carriages movable thereabout for support of pull towers therefrom and whereby the carriages include positive lock structure for locking the carriages in predetermined selected positions about the rack and also structure which positively precludes the use of frictional contact between the rack and pull tower supporting carriages for maintaining the carriages stationery relative to the rack while horizontal pulls or being exerted.

Yet another object of this invention is to provide a vehicle support rack including vehicle stands which are foldably retractable.

Still another object of this invention, in accordance with the immediately preceding object, is to provide vehicle stands which are also readily removably supported from the support rack.

Another object of this is to provide a support rack which is adjustable in height relative to a supporting floor surface and which may be locked in a plurality of horizontal height adjusted positions relative to the floor surface.

A final object of this invention to be specifically enumerated herein is to provide a repair rack in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 3 is an enlarged fragmentary vertical sectional view taken substantially upon the plane indicated by the section line 3—3 of FIG. 1 and illustrating the manner in which one of the pull tower carriages is movably supported from the repair rack and equipped with rollers to prevent frictional contact between the carriage and rack during a pull exerted by a pull tower mounted from the carriage;

FIG. 4 is an enlarged perspective view of one of the pull towers in readiness to exert a generally horizontal pull on a vehicle supported from the rack;

FIG. 5 is another enlarged perspective view of a pull tower with the pull tower embodying a vehicle lift arm whereby a vehicle supported from the rack may be elevated in position relative to the rack;

FIG. 6 is an enlarged fragmentary vertical sectional view taken substantially upon the plane indicated by the section 6—6 of FIG. 4;

FIG. 7 is an enlarged side elevational view of one of the pull tower supporting carriages;

DESCRIPTION OF THE PREFERRED EMBODIMENT

Figure 1:
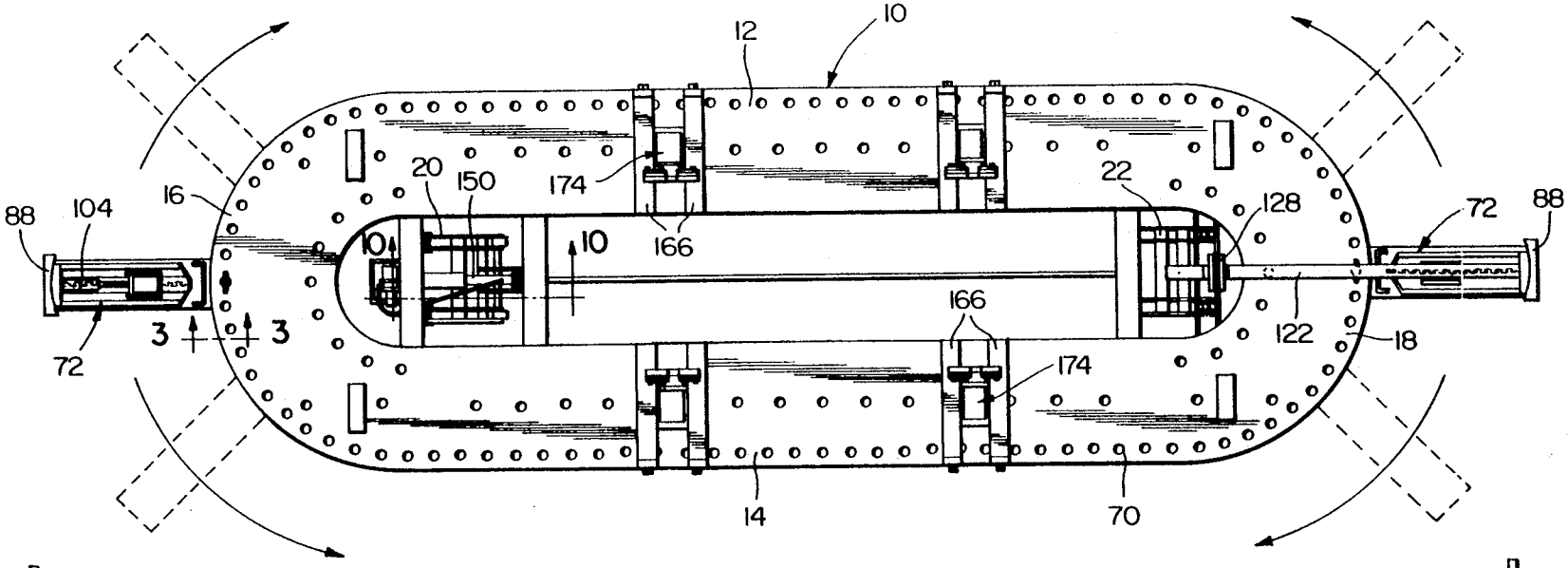
FIG. 1 is a top plan view of the repair rack of the instant invention illustrating a pair of pull tower support carriages supported therefrom for movement about the outer periphery of the track and with foldably retractable vehicle support stands supported from the rack and one of the pull towers equipped with a vehicle lifting arm.

Referring now more specifically to the drawings the numeral 10 generally designates the vehicle collision repair rack of the instant invention. The rack 10 comprises a structure which is ovate in plan shape including a pair of longitudinally straight opposite side portions 12 and 14 whose corresponding ends are interconnected by front and rear semi-circular portions 16 and 18. The rack 10 is supported in elevated position from a suitable flooring 20 through the utilization of pivoted, parallel front and rear legs 20 and 22 and includes vertically short depending front and rear feet 24 and 26 for stationarily supporting the rack 10 from the flooring 20 in a lowered position relative thereto.

When the rack 10 is disposed at its lowermost position supported from the feet 24 and 26, suitable ramp structure (not shown) may be aligned and mated with the front peripheral portion 16 in order to enable a vehicle to be driven up onto (or pulled onto) the ramp 10.

As may be seen from FIG. 3 of the drawings, the ramp 10 includes upper and lower ovate horizontal plates 30 and 32 vertically registered with each other and inner and outer edge upstanding ovate plates 34 and 36 extending between and interconnecting the inner and outer marginal portions, respectively, of the plates 30 and 32. In addition, the lower plate 32 includes a pipe guide rail 38 supported from the under surface of the inner periphery thereof and a second pipe guide rail 40 is supported from the upper surface of the outer periphery thereof.

Figure 11:
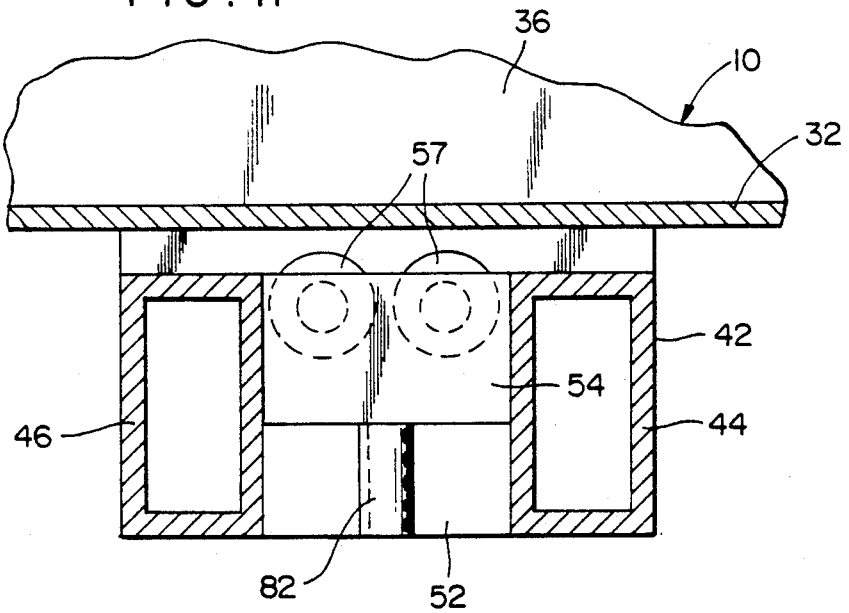
FIG. 11 is an enlarged fragmentary vertical sectional view taken substantially upon the plane indicated by the section line 11—11 of FIG. 3.

Two carriages 42 are supported from the rack 10 for movement thereabout. Each carriage 42 includes a pair of parallel tubular beams 44 and 46 disposed at generally right angles to the adjacent outer peripheral portion of the rack 10. The beams 44 and 46 extend beneath the adjacent marginal portion of the rack 10 and are interconnected at their inner ends by a transverse plate 48 extending and secured therebetween, the transverse plate 48 rotably supporting a grooved guide wheel 50 therefrom rollingly engaged with the underside of the cylindrical guide rail 38. The outer end portions of the tubular beams 44 are interconnected by a transverse plate 52 extending and secured therebetween and an additional pair of connecting plates 54 and 56 extend between and interconnect the tubular beams 44 and 46 beneath the outer margin of the plate 32 and rotatably journal a pair of anti-friction rollers 57 (See FIGS. 3, 7 and 11) therefrom projecting above the tubular beams 44 and 46 and disposed in closely spaced relation relative to the underside of the plate 32, the rollers 57 including inner ends which are vertically registered with the lower margin of the plate 36. Also, a pair of upstanding buttress plates 58 are supported from the beams 44 and 46 and mount an upstanding plate 60 therebetween from which a pair of aligned, grooved rollers 62 corresponding to the roller 50 are journaled. The lower peripheral portions of the rollers 62 are rollingly engaged with the upper cylindrical pipe guide rail 40 mounted from the upper surface of the outer periphery of the plate 32. Still further, the upstanding plate 60 mounts an inverted L-shaped bracket 64 therefrom including an apertured upper horizontal flange 66 and a lock pin 68 is downwardly receivable through a selected aperture 70 of those apertures 70 formed in and spaced along the outer periphery of the upper plate 30 and passes through the aperture in the upper horizontal flange 66, whereby the carriage 42 may be locked in selected position about the rack 10.

The outer end of each carriage 42 supports a pull tower referred to in general by the reference numeral 72 therefrom and each pull tower 72 comprises an L-shaped structure including a horizontal leg 74 and a vertical leg 76, a pair of inclined braces 78 being secured between the end of the horizontal leg 74 remote from the vertical leg 76 and an intermediate height portion of the vertical leg 76. In addition the longitudinal mid-portion of the horizontal leg 74 includes a depending pivot pin 80 which is removably downwardly, rotably received through a guide sleeve 82 supported from the associated carriage 42. The pivot pin 80 extends downwardly below the corresponding guide sleeve 82 and has a retaining sleeve 84 equipped with a set screw (not shown) mounted on the lower end thereof to releasably prevent upward withdrawal of the pivot pin 80 from the guide sleeve 82. Also, the innermost end of each carriage 42 includes an inverted L-shaped bracket 86 constituting a safety bracket for maintaining the associated carriage 42 on the rack 10 and the outer end of the carriage 42 includes a second inverted L-shaped bracket 88 engagable over the outer end extended flange 90 of the corresponding pull tower 72, see FIGS. 1, 2, 4, 5 and 7, the brackets 86 and 88 being removably secured to the inner and outer ends of the carriage 42 by any suitable form of removable fasteners (not shown).

Each vertical leg 76 includes a pair of uprights 92 having horizontally registered and vertically spaced pairs of transverse bores 94 formed therethrough. Also, a notched end plate 96 is mounted upon the free end of the horizontal leg 74 and includes a chain anchoring notch 98 formed therein. Further, the horizontal leg 74 includes a longitudinal guide 100 upon which a slide 102 is mounted for guided movement therealong and one end of a double acting hydraulic cylinder 104 is anchored to the slide 102 as at 105 while the other end of the hydraulic cylinder 104 is anchored to the lower end of the vertical leg 76. The slide 102 includes a chain anchoring opening 106 through which a length of chain 108 passes and the chain 108 also passes through the notch 98. In addition, the chain 108 passes about a pulley 110 journaled from a vertically adjustable pin 112 secured through the lower pair of bores 94 and also over a pulley 114 journaled from a vertically adjustable pin 116 removably secured through an upper pair of the bores 94. The end of the chain 108 remote from the notch 98 may be anchored relative to any portion of an associated vehicle (not shown) supported from the rack 10 and upon which a pull is to be exerted. By engagement of the chain 108 in the chain anchoring opening 106 and extension of the hydraulic cylinder 104, a pull will be exerted on the upper end of the chain 108 and the portion of the associated vehicle to which the upper end of the chain is attached. If a pull of an extent greater than the maximum stroke of the hydraulic cylinder is desired, after the first extension of the hydraulic cylinder 104, the chain 108 is anchored at the notch 98 and released at the opening 106. Then, the hydraulic cylinder 104 is retracted and the chain is subsequently again anchored at the opening 106. Then, during the next extension of the hydraulic cylinder 104, a further pull on the upper end of the chain 108 may be exerted.

With attention now invited more specifically to FIG. 5, it may be seen that a third pivot pin 120 has been secured through the pair of bores 94 spaced immediately above the pivot pin 112 and that the pivot pin 120 pivotally mounts the base end of a lift arm 122 having a mid-length chain anchor 124 thereon to which the upper end of the chain 108 is anchored. The outer or free end of the lift arm 122 has a slide 126 slidably mounted thereon and releasably securable in adjusted positions therealong. The slide 126 pivotally supports a pinch weld receiving slot 128 therefrom for engagement with the pinch weld area of a uni-body construction. The pinch weld receiving slot 128 be of any suitable type.

Figure 12:
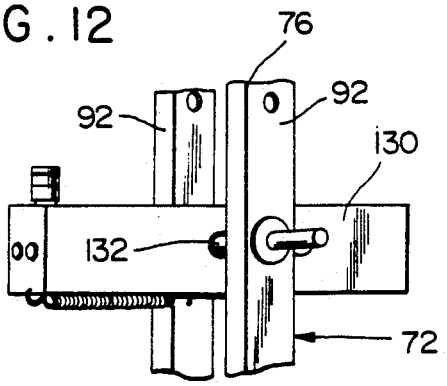
FIG. 12 is a fragmentary, enlarged perspective view of an upper portion of one of the pull towers illustrating a hydraulic cylinder powered pull arm pivotally supported therefrom.

Also, with attention now invited more specifically to FIG. 12, in lieu of the upper pivot pin 116 and the pulley 114, a hydraulic cylinder powered pull arm 130 operationally similar to the pull arm disclosed in U.S. Pat. No. 4,712,417 may be pivotally supported from the upper end of the vertical leg 76 through the utilization of a pivot pin 132 corresponding to the pivot pin 116.

Figure 2:
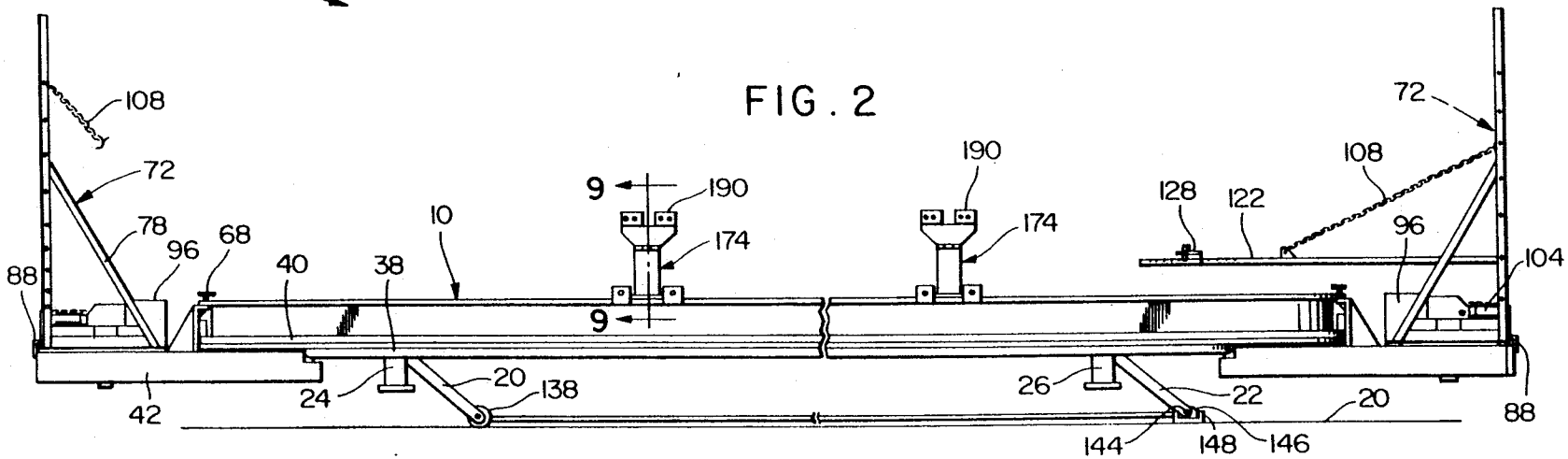
FIG. 2 is a side elevational view of the assemblage illustrated in FIG. 1.
Figure 10:
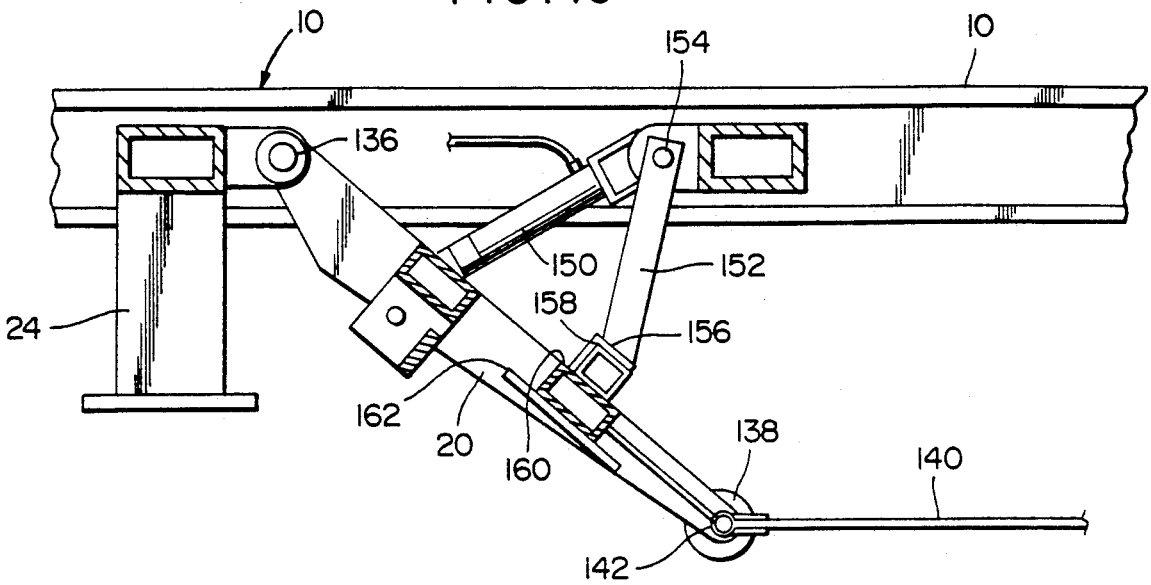
FIG. 10 is an enlarged fragmentary vertical sectional view taken substantially upon the plane indicated by the section line 10—10 of FIG. 1 and illustrating a portion of the jack structure by which the rack may be elevated in selected positions relative to a supporting floor surface.

With attention now invited more specifically to FIGS. 2 and 10, the leg 20 is pivotally supported from the rack 10 as at 136 and has floor engagable rollers 138 journaled from its lower end. In addition, an elongated connecting rod 140 is pivotally anchored at its forward end to the lower end of the leg 20 as at 142 and to the lower end of the rear leg 22 as at 144, whereby the legs 20 and 22 are interconnected for simultaneous and equal angular displacement relative to the rack 10. The lower end of the leg 22 is equipped with rollers 146 corresponding to the rollers 138, but the rollers 146 are seated in a transverse channel 148 secured to the flooring 120 whereby the rack 10 is stationarily supported from the flooring 20 against shifting movement relative thereto.

A remotely operable hydraulic cylinder 150 is operably connected between the rack 10 and an intermediate length portion of the leg 20 for forcibly angularly displacing the leg 20 relative to the rack and an elongated safety prop 152 is pivotally supported from the rack 10 as at 154 and includes an angle member 156 on its free end selectively engagable with points 158, 160 and 162 (see FIG. 10) in order to positively define selected elevated positions of the rack 10 above the lowermost position thereof with its feet 24 and 26 engaged with the flooring 20.

Figure 8:
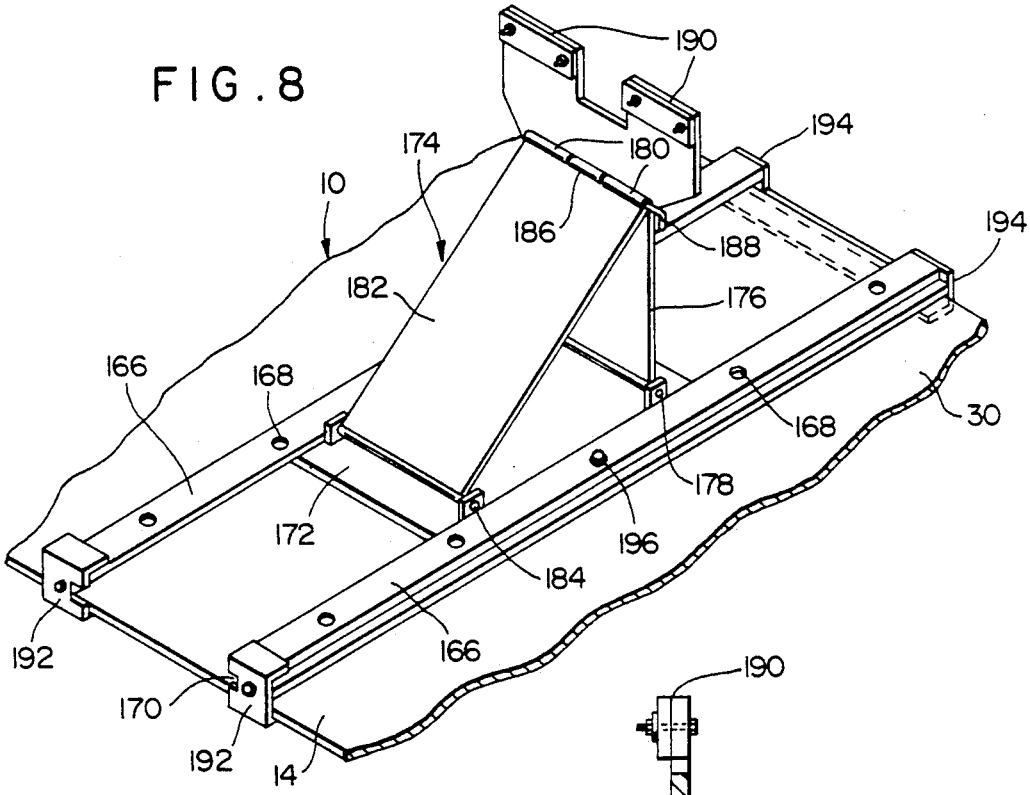
FIG. 8 is an enlarged perspective view of one of the foldably retractable vehicle stands supported from the rack.
Figure 9:
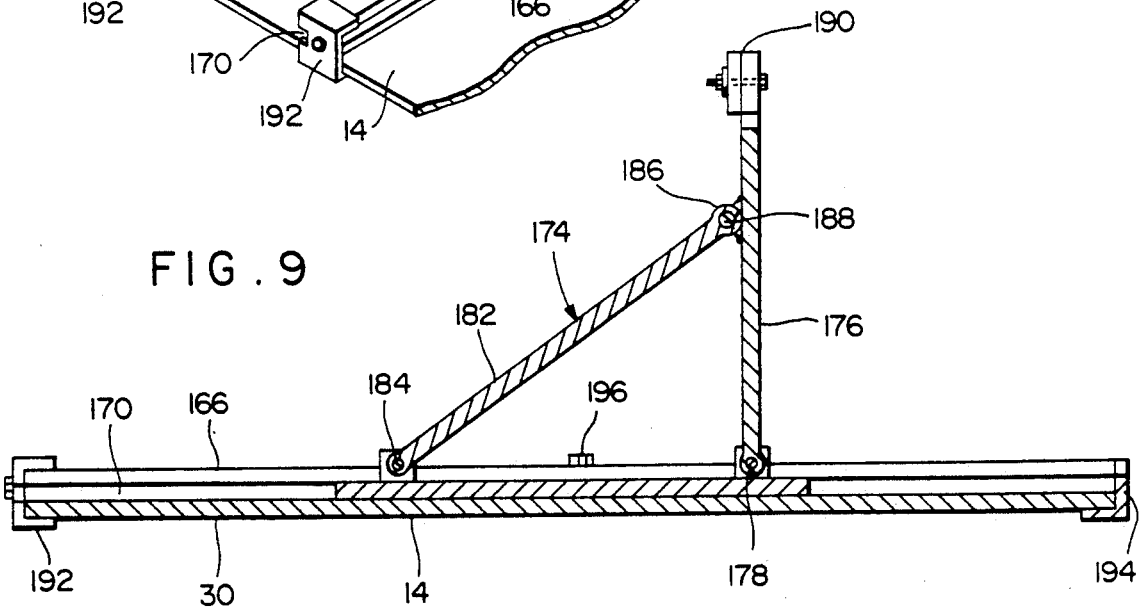
FIG. 9 is an enlarged vertical sectional view taken substantially upon the plane indicated by the section line 9—9 of FIG. 2.

With attention now invited more specifically to FIGS. 1, 8 and 9, longitudinally spaced portions of each of the side portions 12 and 14 of the rack 10 include pairs of transverse guideways 166 supported therefrom each including a plurality of components secured together by suitable fasteners 168. Each pair of guideways 166 define a guide way area 170 in which to shiftably receive a corresponding base plate 172 from the outer margin of the corresponding side portion of the rack 10. Each base plate 172 comprises the base of a vehicle support stand referred to in general by the reference numeral 174. Each stand 174 includes an upright plate 176 pivotally supported from the base plate 172 as at 178 and supporting a pair of axially spaced apart and horizontally aligned hinge barrels 180 on the outer surface of an upper end portion thereof. In addition, each stand 174 further includes an inclined plate 182 pivotally supported from the corresponding base plate 172 at 184 and equipped with a single hinge barrel 186 on its upper end received between and axially aligned with the hinge barrels 180, a removable hinge or latch pin 188 being passed through the barrels 180 and 186 in order to lock the upright plate 176 in an upright position. The upper end of the upright plate 176 includes pinch weld area clamps 190 which may be removably clamp engaged with pinch weld areas of a uni-body construction vehicle. When the pin 188 is removed, the upstanding plate 176 as well as the inclined plate 182 may be inwardly and downwardly swung toward collapsed positions thereof closely overlying the upper plate 30 and the base plate 172, respectively.

In operation, the rack 10 is first lowered to the lowest position thereof with the feet 24 and 26 engaged with and supported from the flooring 20. Then, a vehicle to be worked upon is loaded onto the rack 10 from the forward end portion 16 thereof. Thereafter, the pull towers 72 are equipped with the lift arms 122 and positioned at one side of the vehicle at points spaced longitudinally therealong, the carriages 42 being locked into the desired positions thereof by the pins 68. The hydraulic cylinders 104 are utilized to upwardly swing the outer ends of the lift arms 122 to elevate the pinch weld clamps 128 into positions closely beneath longitudinally spaced portions of the associated pinch weld area of the vehicle disposed on the rack 10. The pinch weld clamps 128 are then clamped to the near pinch weld areas while manual pressure is applied to the outer ends of the lift arms 122 in order to elevate the same sufficiently to enable the pinch weld clamps 128 to be clamp engaged with the pinch weld areas and the hydraulic cylinders 104 are then further actuated to lift the adjacent side of the vehicle. Thereafter, the vehicle support stands 174 are swung upwardly from their downwardly retracted positions and locked in the upstanding positions thereof through utilization of the pins 88.

The fasteners 168 do not secure the guideways 166 to the upper plate 30, but brackets 192 and 194 removably and fixedly secured, respectively, at opposite ends of the guideways 166 support the guideways 166 from the upper plate 14 for shifting movement therealong into the desired positions. Thereafter, the pinch weld clamps 190 are opened and the vehicle is lowered by the hydraulic cylinders 104 as the base plates 172 are adjusted in position along the guideways 166. Then, the pinch weld clamps are engaged with the adjacent pinch weld areas of the associated vehicle and the pinch weld clamps 128 may be released and the lift arms 122 may be lowered. Thereafter, the carriages 42 are moved around the rack 10 to the opposite side of the vehicle and the lift arms 122 are utilized to lift other side of the vehicle for the purpose of engaging the pinch weld clamps 190 of the opposite side vehicle support stands 174 with the pinch weld areas on that side of the vehicle. After the four vehicle support stands 174 have been engaged with the pinch weld areas of the vehicle on opposite sides thereof, the set screws 196 carried by the guideways 166 may be tightened to maintain the base plates 172 in adjusted positions relative to the guideways 166 and the upper plate 30, the set screws 196 bearing down up on the plates 172 and forcing the latter down into tight clamped engagement with the upper plate 30.

Thereafter, the necessary pulls may be exerted on the body of the vehicle either through the utilization of the chain 108 in the manner illustrated in FIG. 4 or through the utilization of a second chain (not shown) operatively associated with the pull arm 130 illustrated in FIG. 12, the pull arm 130 being adjustably positionable along the vertical leg 76 of the pull tower 72. Further, while pulls are being applied on the body of a vehicle anchored relative to the rack 10, the tower 72 tilts inwardly at its upper end and the carriage 42 is similarly tilted, thus contacting the upper peripheral portions of rollers 57 with the opposing under surface portion of plate 32. The rollers 57 are provided to enable free shifting of the carriage 42 while the latter is tilted and to thereby require the use of the pins 68 to lock the carriage in adjusted positions, rather than relying upon undependable frictional engagement between the rack 10 and the carriage 42 at the area of the rollers 57, were the latter not provided.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A vehicle repair support rack including anchor means for stationarily supporting vehicle frame means thereon and defining at least one longitudinal side portion, at least one carriage mounted from said side portion for guided movement therealong and projecting outwardly from said side portion, said carriage and support rack side portion including co-acting lock means operative to positively releasably lock said carriage in selected adjusted positions along said rack one side portion, a pull tower mounted from said carriage outwardly of said one side portion for angular displacement relative to said carriage about an upstanding axis, an upper portion of said tower including pull means operatively associated therewith for engagement with a vehicle portion supported from said rack and disposed inwardly of said pull tower and adapted to exert an outward pull on said vehicle portion toward said tower, said carriage and rack including co-acting antifriction means operative to ensure against sliding frictional engagement between said rack and carriage as a result of tilting of said carriage relative to said rack during a pull exerted by said pull means.

2. The support rack of claim including depending stationary feet carried by said rack for engagement with a floor surface therebeneath to define a low elevated position of said rack relative to said floor surface, longitudinally spaced portions of said rack including elongated, parallel inclined legs pivotally attached at their upper ends relative to said rack for angular displacement relative thereto about horizontal transverse axes, elongated connecting means pivotally interconnected between lower end portions of said legs, power means operatively connected between said rack and only one of said legs for forcibly downwardly swinging the lower end of said one leg relative to said rack to thereby lift said rack and feet from engagement with said floor surface.

3. The rack of claim 2 including prop means operatively associated with said rack and said one leg operative to releasably limit upward swinging of the lower end of said one leg relative to said rack past a position with the feet of said rack spaced above a horizontal plane containing the lower ends of said legs.

4. The rack of claim 1 including a plurality of vehicle stands mounted from said side portion of said rack for independent guided shifting therealong, said stands projecting appreciably upwardly above said rack and being downwardly foldable toward said rack.

5. The rack of claim 4 wherein said vehicle stands include upper end portions from which pinch weld clamps are supported.

6. The rack of claim 4 wherein said stands and rack include co-acting means also guidingly supporting said stands from said rack for independent shifting transversely of said rack side portion, and single means carried by each stand operable to releasably lock the corresponding stand in adjusted position on said rack against shifting both along the corresponding side portion of said rack and transversely of the rack side portion.

7. A vehicle repair support rack including anchor means for stationarily supporting vehicle frame means thereon and defining at least one longitudinal side portion, at least one carriage mounted from said side portion for guided movement therealong and projecting outwardly from said side portion, said carriage and support rack side portion including co-acting lock means operative to positively releasably lock said carriage in selected adjusted positions along said rack one side portion, a pull tower mounted from said carriage outwardly of said one side portion for angular displacement relative to said carriage about an upstanding axis, an upper portion of said tower including pull means operatively associated therewith for engagement with a vehicle portion supported from said rack and disposed inwardly of said pull tower and adapted to exert an outward pull on said vehicle portion toward said tower, a plurality of vehicle stands mounted from said side portion of said rack for independent guided shifting therealong, said stands projecting appreciably upwardly above said rack and being downwardly foldable toward said rack, said stands and rack including co-acting means also guidingly supporting said stands from said rack for independent shifting transversely of said rack, and single means carried by each stand operable to releasably lock the corresponding stand in adjusted position on said rack against shifting both along the corresponding side portion of said rack and transversely of the rack side portion.

8. The rack of claim 7 wherein said vehicle stands include upper end portions from which pinch weld clamps are supported.

9. A vehicle repair support rack including anchor means for stationarily supporting vehicle frame means thereon and defining at least one longitudinal side portion, at least one carriage mounted from said side portion for guided movement therealong and projecting outwardly from said side portion, said carriage and support rack side portion including co-acting lock means operative to positively releasably lock said carriage in selected adjusted positions along said rack one side portion, a pull tower mounted from said carriage outwardly of said one side portion for angular displacement relative to said carriage about an upstanding axis, an upper portion of said tower including pull means operatively associated therewith for engagement with a vehicle portion supported from said rack and disposed inwardly of said pull tower and adapted to exert an outward pull on said vehicle portion toward said tower, said carriage and rack including co-acting antifriction means operative to ensure against sliding frictional engagement between said rack and carriage as a result of tilting of said carriage relative to said rack during a pull exerted by said pull means, said tower including a generally horizontal lift arm extending inwardly toward and over said side portion of said rack, the outer end of said lift arm being pivotally mounted from said tower for oscillation relative thereto about a horizontal axis extending transversely of said lift arm, the inner end of said lift arm including support means for engagement beneath and supporting a vehicle body portion disposed thereabove, said pull means being operatively connected between said tower and an intermediate portion of said lift arm for raising the inner end thereof relative to said pull tower and thus lifting said vehicle body relative to said rack, a plurality of vehicle stands mounted from said side portion of said rack for independent guided shifting therealong, said stands projecting appreciably upwardly above said rack and being downwardly foldable toward said rack, said stands and rack including co-acting means also guidingly supporting said stands from said rack for independent shifting transversely of said rack.

10. The rack of claim 9 wherein said vehicle stands include upper end portions from which pinch weld clamps are supported.

11. A vehicle repair support rack including anchor means for stationarily supporting vehicle frame means thereon and defining at least one longitudinal side portion, at least one carriage mounted from said side portion for guided movement therealong and projecting outwardly from said side portion, said carriage and support rack side portion including co-acting lock means operative to positively releasably lock said carriage in selected adjusted positions along said rack one side portion, a pull tower mounted from said carriage outwardly of said one side portion for angular displacement relative to said carriage about an upstanding axis, an upper portion of said tower including pull means operatively associated therewith for engagement with a vehicle portion supported from said rack and disposed inwardly of said pull tower and adapted to exert an outward pull on said vehicle portion toward said tower, said tower including a generally horizontal lift arm extending inwardly toward and over said side portion of said rack, the outer end of said lift arm being pivotally mounted from said tower for oscillation relative thereto about a horizontal axis extending transversely of said lift arm, the inner end of said lift arm including support means for engagement beneath and supporting a vehicle body portion disposed thereabove, said pull means being operatively connected between said tower and an intermediate portion of said lift arm for raising the inner end thereof relative to said pull tower and thus lifting said vehicle body relative to said rack, said support means carried by the inner end of said lift arm comprising pinch weld clamp structure for clampingly engaging the pinch weld area of a vehicle body, a plurality of vehicle stands mounted from said side portion of said rack for independent guided shifting therealong, said stands projecting appreciably upwardly above said rack and being downwardly foldable toward said rack, said stands and rack including co-acting means also guidingly supporting said stands from said rack for independent shifting transversely of said rack, said carriage and rack include co-acting antifriction means operative to ensure against sliding frictional engagement between said rack and carriage as a result of tilting of said carriage relative to said rack during a pull exerted by said pull means.

12. The rack of claim 11 including depending stationary feet carried by said rack for engagement with a floor surface therebeneath to define a low elevated position of said rack relative to said floor surface, longitudinally spaced portions of said rack including elongated, parallel inclined legs pivotally attached at their upper ends relative to said rack for angular displacement relative thereto about horizontal transverse axes, elongated connecting means pivotally interconnected between lower end portions of said legs, power means operatively connected between said rack and one of said legs for forcibly downwardly swinging the lower end of said one leg relative to said rack to thereby lift said rack and feet from engagement with said floor surface.

13. The rack of claim 12 including prop means operatively associated with said rack and said one leg operative to releasably limit upward swinging of the lower end of said one leg relative to said rack past a position with the feet of said rack spaced above a horizontal plane containing the lower ends of said legs.

* * * * *